United States Patent [19]

Ewig

[11] 4,184,620

[45] Jan. 22, 1980

[54] SPRING POWERED STAPLER

[75] Inventor: John Ewig, Worcester, Mass.

[73] Assignee: Parker Manufacturing Company, Worcester, Mass.

[21] Appl. No.: 907,592

[22] Filed: May 19, 1978

Related U.S. Application Data

[62] Division of Ser. No. 820,442, Aug. 1, 1977, Pat. No. 4,119,258.

[51] Int. Cl.[2] ..... B25C 5/10

[52] U.S. Cl. ..... 227/8; 227/128; 227/132; 227/146

[58] Field of Search ..... 227/8, 120, 127, 128, 227/132, 146

[56] References Cited

U.S. PATENT DOCUMENTS

| | | | |
|---|---|---|---|
| 2,361,483 | 10/1944 | Lang | 227/132 |
| 2,907,039 | 10/1959 | Siemssen et al. | 227/128 |
| 3,149,339 | 9/1964 | Johnson | 227/132 |
| 3,612,380 | 10/1971 | Kuhlman | 227/120 |
| 4,119,258 | 10/1978 | Ewig, Jr. | 227/132 |

*Primary Examiner*—John McQuade

*Attorney, Agent, or Firm*—Norman S. Blodgett; Gerry A. Blodgett

[57] ABSTRACT

A stapler having a frame formed in two parts of high density polymer, wherein the major support and guide elements of the stapler are integrally formed with the two parts.

2 Claims, 10 Drawing Figures

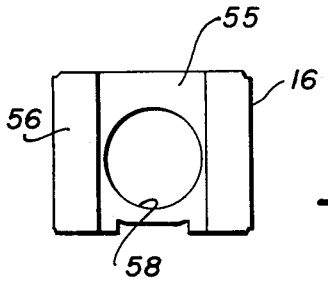
FIG. 9
FIG. 8
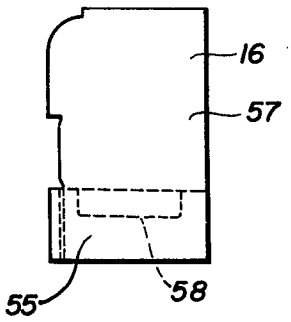
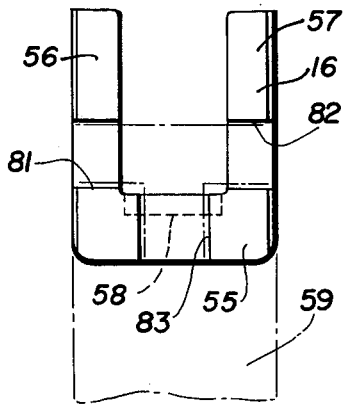
FIG. 7
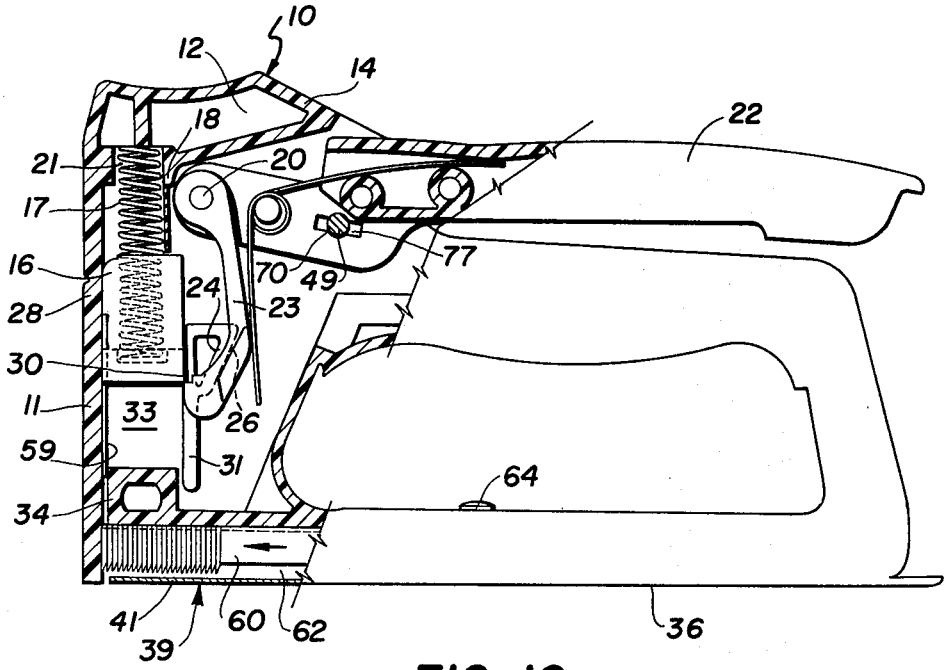
FIG. 10

SPRING POWERED STAPLER

This is a division of application Ser. No. 820,442 filed Aug. 1, 1977, now U.S. Pat. No. 4,119,258, issued Oct. 10, 1978.

BACKGROUND OF THE INVENTION

Staplers and stapling guns are extensively used commercially and in the building trades for such purposes as fastening plastic sheet to wood for the purpose of protecting it. Staples of this type are shown in the U.S. Pat. of Johnson No. 3,149,339 of Sept. 22, 1964. Such heavy-duty uses demand a rugged, long-wearing stapler and the user does not object to paying a high price for such a piece of equipment. Staplers also find use domestically, but for such purposes the stapler does need to be as rugged; furthermore, the homeowner would prefer not to pay the high price of a heavy-duty stapler. Nevertheless, it has been difficult to manufacture a low-cost stapler, because of the inherent high cost of the stamped metal parts and the labor involved in assembling these parts. Furthermore, even though the commercial version of a stapler can be fairly heavy in weight without presenting any problem, the home market needs a light weight stapler. These and other difficulties experienced with the prior art devices have been obviated in a novel manner by the present invention.

It is, therefore, an outstanding object of the invention to provide a stapler which can be assembled from a minimum number of parts.

Another object of this invention is the provision of a stapler which is light in weight and, therefore, readily adaptable to domestic use.

A further object of the present invention is the provision of a stapler which, although light in weight is, because of its design, substantially rugged.

It is another object of the instant invention to provide a stapler which is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a stapler with a frame that has two-spaced side walls, each in the shape of a plane, closed figure and formed of a high density polymer. Each side wall is provided with an inwardly-directed peripheral web, the edges of these webs engaging at a central plane which is parallel to both side walls. A hammer is slidable between the side walls and a spring, residing between the walls, engages one end of the hammer. An actuating lever is hingedly attached to the frame and a lifter is connected to the lever for raising the hammer against spring pressure and releasing it to drive a staple.

More specifically, each side wall has an inwardly-directed flange, the side walls and the flanges combining with straight portions of the peripheral webs to form a cavity for enclosing one end of the spring. The lifter is provided with spaced parallel side surfaces that are spaced apart by an amount that is substantially less than the space between the side walls. The lifter is also provided with laterally-extending abutments protruding from the side surfaces and each side wall is provided with an inwardly-directed flange. The inward ends of the flanges are spaced and parallel to receive the said side surfaces of the lifter slidably between them. The flanges also have inclined cam surfaces adapted to be engaged by the lifter abutments on occasion. Each side wall is also provided with an integral flange which is parallel to a straight portion of the peripheral web, thus forming a box-like enclosure in which the hammer is slidable. Each side wall is also provided with an integral, inwardly-directed box-like element, which elements meet at the central plane to form a resilient member to engage the hammer at the end of its movement and to absorb energy therefrom. A bottom edge of the frame is provided with a straight edge and each side wall has a rabbet along this bottom edge. A staple magazine is mounted along the bottom edge and is formed with a channel element of U-shaped cross-section whose legs reside so as to be slidable lengthwise in the rabbets. One end of each leg of the channel element has a finger that engages a notch in the frame, the other end of each leg has an aperture. Each side wall has an aperture in the vicinity oı the channel element aperture, the aperture in the frame being elongated in the direction of sliding motion of the channel element. A pivot pin extends through the channel element apertures and the side wall apertures to act as a hinge element. A spring member operates to bias the channel element relative to the side walls in the direction of the straight bottom edge, so that the finger is maintained tightly engaged in the notch in the frame normally to prevent rotation of the staple magazine about the pivot pin. The actuating lever is pivotally attached to the frame by means of a hinge pin and the hinge pin has a longitudinal protuberance. This pin is slidable transversely of the frame to cause the pin to move inwardly to a locking position in which the protuberance engages a notch in the edge of a bore in the frame and a bore in the lever.

BRIEF DESCRIPTION OF THE DRAWINGS

The character of the invention, however, may be best understood by reference to one of its structural forms, as illustrated by the accompanying drawings, in which:

FIG. 10 is a side elevational view partially sectioned, showing the stapler in a different phase of its operation.

DESCRIPTION OF THE PREFERRED EMBODIMENT

Figure 1:
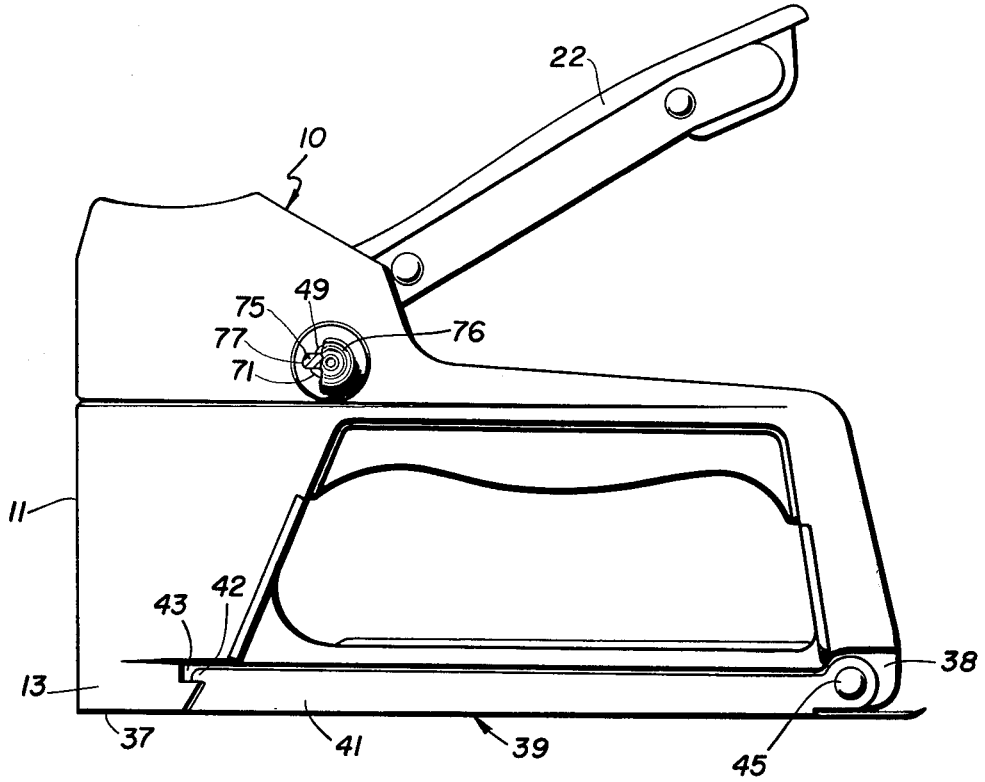
FIG. 1 is a side elevational view of a stapler embodying the principles of the present invention.
Figure 2:
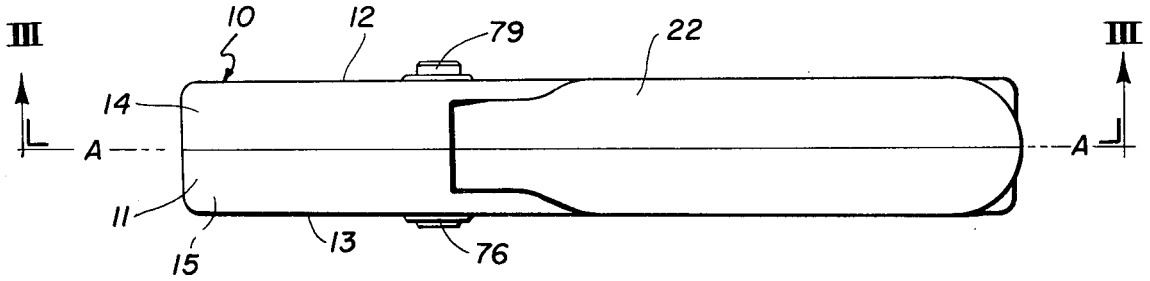
FIG. 2 is a plan view of the stapler.

Referring first to FIGS. 1 and 2, wherein are shown the general features of the invention, the stapler, indicated generally by the reference numeral 10, is shown as having a frame 11, which consists of two spaced parallel side walls 12 and 13, each of which is in the general shape of a closed plane figure. Pivotally mounted on the top of the frame is an actuating lever 22 hindedly mounted on a pivot pin 49. The side wall 12 is provided with an inwardly-directed peripheral web 14, while the side wall 13 is provided with a similar peripheral web 15, the edges of the two webs meeting on a center plane A—A and are joined together by adhesive or the like or any other manner well-known in the art.

Figure 3:
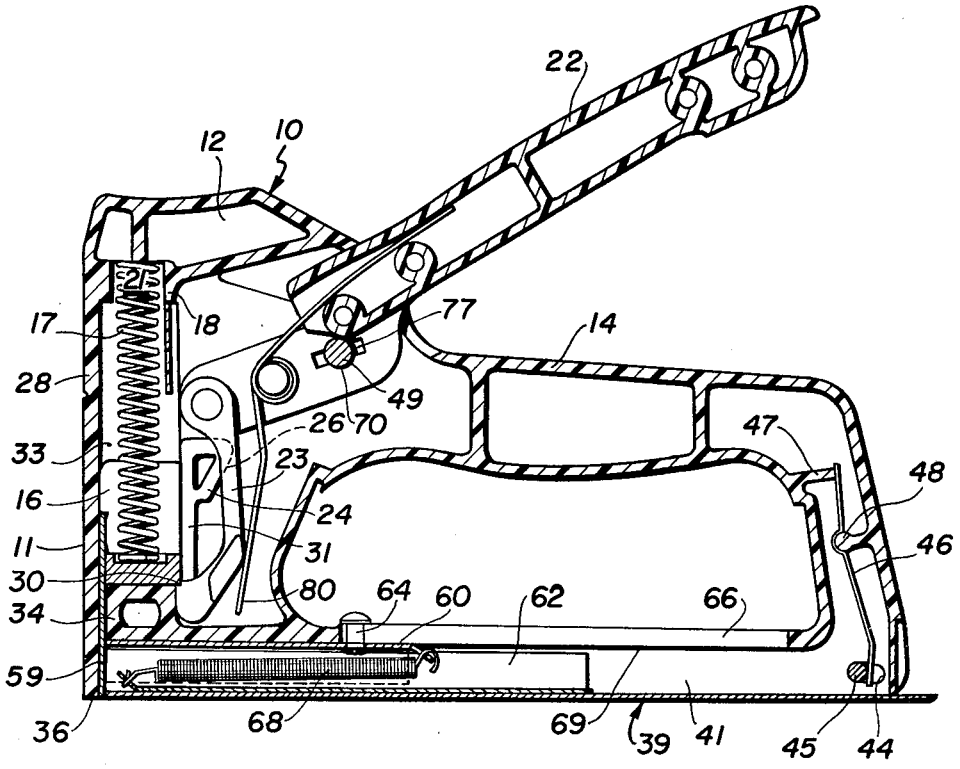
FIG. 3 is a vertical sectional view of the stapler taken on the line III—III of FIG. 2.
Figure 4:
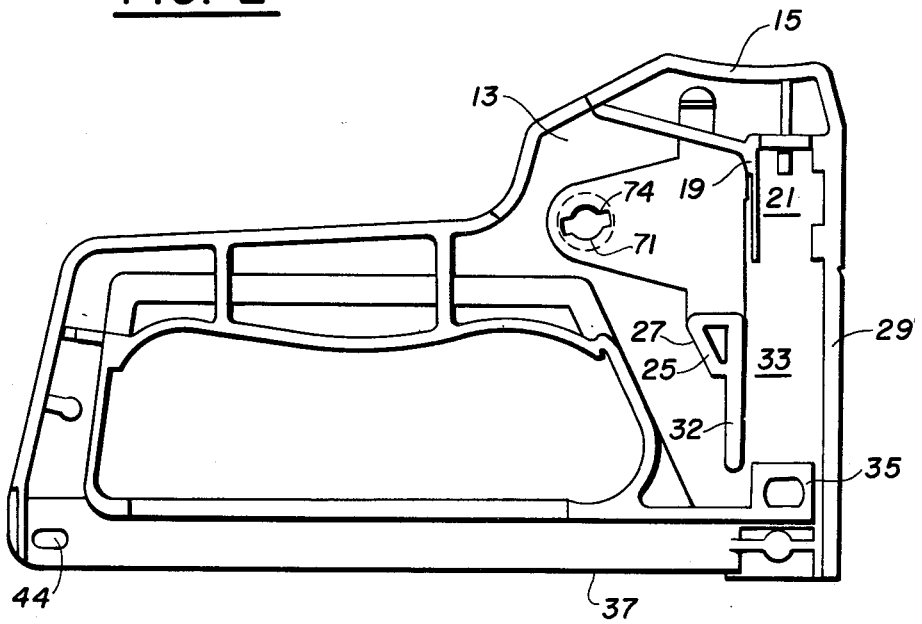
FIG. 4 is a view of the inside surface of an unassembled side wall forming part of the stapler.

FIG. 3 shows the configuration of the side wall 12 and of various elements integrally formed with it of a high density polymer by the injection molding process. Similarly, FIG. 4 shows the other side wall 13 (which is a mirror image of side wall 12) and a number of flanges, webs, and protuberances which are formed integrally with it. These are, in most cases, designed to meet corresponding flanges, etc., on the side wall 12. A hammer 16 is slidable between the walls and a spring 17 resides between the side walls and engages the hammer at one end. The side walls 12 and 13 are provided with inwardly-directed flanges 18 and 19, respectively, the side walls and the flanges 18 and 19 forming a cavity enclosing the upper end of the spring. A lifter 23 is pivotally connected to the lever 22 at 20 and includes a notch 30 for engaging the bottom edge of the hammer for raising the hammer against the pressure of the spring 17 and thereafter releasing it to drive a staple.

The side walls 12 and 13 are provided with integral flanges 24 and 25, respectively, having surfaces 26 and 27 which are inclined to the direction of motion of the hammer. The innermost end surfaces of these flanges are substantially spaced from the center plane, so that substantial portions of the lifter are guided between them. The inclined surfaces form cams that are engaged on occasion by a portion of the lifter to move it laterally to release the hammer.

The peripheral webs 14 and 15 of the side walls 12 and 13 are provided, respectively, with matching straight portions 28 and 29. Side walls 12 and 13 are provided with integral, inwardly-directed flanges 31 and 32, respectively, which are parallel to the said straight portions of the peripheral webs. The side walls 12 and 13, the straight portions 28 and 29 of the webs, and the flanges 31 and 32 form a box-like enclosure 33 in which the hammer 16 is slidable.

The side walls 12 and 13 are also provided with integral, inwardly-directed box-like elements 34 and 35 which meet at the said central plane A—A to form a resilient member which is engaged by the hammer at the bottom of its movement and which absorbs energy therefrom. The hammer is normally pressed by the spring 17 into engagement with these elements 34 and 35.

The frame 11 is provided with an extensive straight bottom edge formed by bottom edges 36 and 37 of the side walls 12 and 13, respectively. These edges of the side walls are free of the peripheral webs. Each side wall has a rabbet 38 (see FIG. 1) extending along the bottom edge. A staple magazine 39 is mounted along the bottom edge and is formed with a channel element 41 of U-shaped cross-section. The legs of the channel element reside in the rabbets and are slidable lengthwise of the rabbets. As seen in FIG. 2, the magazine 39 does not extend beyond the sides of the stapler. One end of each leg of the channel element has a finger 42 that engages a notch 43 formed in the frame, the other end of each leg of the channel element has an aperture. Each side wall 12 and 13 has an aperture 44 in the vicinity of the channel element aperture. The apertures in the side walls are elongated in the direction of sliding motion of the channel element and a pivot pin 45 extends through the channel element apertures and the side wall apertures 44 to act as a hinge element. A spring member 46 operates to bias the channel element relative to the side walls in the direction of the straight bottom edge, so that the finger 42 is maintained tightly engaged in the notch 43 in the frame normally to prevent rotation of the staple magazine 39 about the pivot pin 45. The spring member 46 consists of an elongated leaf spring which is wide enough to extend from one side wall 12 to the other side wall 13. One end of the spring engages the pin 45 to bias it laterally and to press the staple magazine in the direction of the finger 42 and the notch 43, this motion being allowed by the elongation of the apertures 44 in the side walls. The interior of the frame is provided with integral abutments 47 and 48 that retain the other end of the spring. More specifically, the spring 46 is formed to have a semi-circular portion which engages a cylindrical surface on the abutment 48 that serves to lock the spring in place against longitudinal movement, while allowing a degree of pivotal motion.

A staple pusher 60 is slidably mounted above the magazine 39 and includes downwardly-extending legs which straddle a wall 62 which extend upwardly from the base of the element 41 when the element 41 is locked in operating position as shown in FIGS. 1 and 3. A guide pin 64 is fixed to the base of the staple pusher and is slidably mounted in a slot 66 formed between the lowermost horizontal matching positions of webs 14 and 15. This enables the staple pusher 60 to slide relative to magazine 39. One end of a spring 68 is anchored to the base of the magazine and the other end thereof is anchored to the staple pusher 60, so as to urge the staple pusher toward the front of the stapler as shown in FIG. 3.

Staples are loaded into the magazine by sliding the channel element 41 rearwardly so that fingers 42 clear notches 43, thereby allowing the magazine 39 to swing around pivot pin 45. After staples have been inserted in the magazine, the staple pusher 60 urges them toward the forward end of the stapler as shown in FIG. 10.

The actuating lever 22 is provided with a bore 70 and a pivot pin 49 extends through both a bore 71 in the frame and the said bore 70 to permit hinged movement of the lever. The pin 49 has a button 76 which extends beyond frame member 12, as shown in FIG. 2, and a longitudinal protuberance or key 75. The pin 49 is slidable transversely of the frame by a limited amount by pushing button 76 to cause the pin to move inwardly to a locking position in which the protuberance engages a notch or keyway 74 in the surface which defines the bore of the frame and a keyway 77 in the surface which defines the bore in the lever. In this position, the lever is locked in an inoperative position and the stapler cannot be operated. The opposite end of pin 49 has a button 79, which extends beyond side member 12. When the pin 49 is pushed to a front position by pushing button 79, the protuberance does not engage the keyway in the bore of the lever and the lever is free to pivot.

Figure 5:
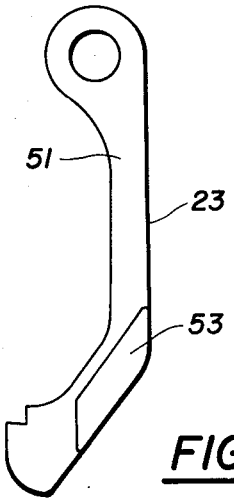
FIG. 5 is a side elevational view of a lifter.
Figure 6:
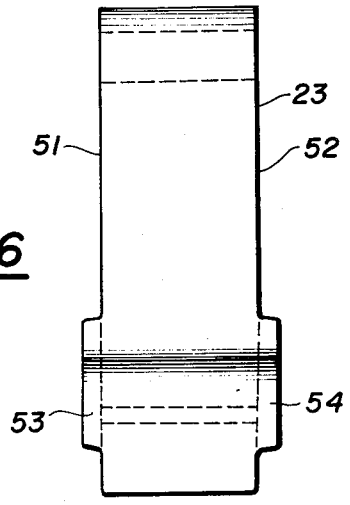
FIG. 6 is a rear elevational view of a lifter taken from the right-hand side of FIG. 5, FIGS. 7, 8, and 9 are front, side, and plan views of a hammer forming part of the stapler.

As is best evident in FIGS. 5 and 6, the lifter 23 is provided with spaced parallel side surfaces 51 and 52 that are spaced apart by an amount that is substantially less than the space between the side walls. The lifter is also provided with protuberances 53 and 54 that extend laterally from the side surfaces. As has been stated, each side wall 12 and 13 is provided with an inwardly-directed flange 24 and 25, the inward edges of the flanges being spaced and parallel to one another receive the said side surfaces 51 and 52 of the lifter between them and to guide the lifter in its movement. The flanges also are formed with the inclined cam surfaces 26 and 27, which are adapted to be engaged by the protuberances 53 and 54. FIGS. 7, 8, and 9 show that the hammer 16 consists of a base 55 from the sides of which rise arms 56 and 57. Extending into the top surface of the base 55 is a circular recess 58 formed to receive the lower end of the spring 17.

The operation and advantages of the present invention will now be readily understood in view of the above description. By pressing on button 79, the pivot pin 49 is moved forwardly and the actuating lever 22 is released so as to rotate freely about the pivot pin. FIG. 3 shows the apparatus in its normal condition in which the spring 17 is under a slight compression and the hammer 16 rests against the elements 34 and 35. When the actuating lever 22 is pressed downwardly, the lifter 23 (which engages a corner of the hammer 16) is raised upwardly. A compression spring 80 urges lifter 23 into engagement with hammer 16. The surfaces 51 and 52 of the lifter are guided between the two flanges 24 and 25. Eventually, the abutments 53 and 54 on the lifter engage the inclined surfaces 26 and 27 on the flanges 24 and 25, respectively. When this occurs, the lifter is rotated counter-clockwise about its pivotal connection to the inner end of the actuating lever 22. Eventually, it rotates sufficiently that it no longer engages the inner corner of the hammer 16 and the hammer (which has been placed under more and more compression by the spring 17) starts to travel downwardly. In its downward travel it carries the usual staple driver 59 (see FIG. 3) which passes downwardly and engages the foremost staple in the cartridge of staples lying in the staple magazine 39 and drives it out in the usual way. In the preferred embodiment, the hammer 16 is formed of sintered powdered metal and is provided with three grooves identified by the reference numerals 81, 82, and 83 in FIG. 7 to carry a cruciform staple driver 59. FIG. 10 shows the condition of the apparatus just as the lifter 23 has released the hammer and it starts its downward motion. When it reaches the bottom of its stroke, it has used up a considerable portion of its energy in driving the staple and the rest of the energy is absorbed by the two resilient box-like elements 34 and 35. The spring has been guided at all times, first of all, by its upper end engaging the inner surfaces of the enclosure 21 formed by the flanges 18 and 19 on the one hand, the side walls 12 and 13 on the other hand, and by the straight portions 28 and 29 of the webs 14 and 15 of the side walls. When it is necessary to supply more staples to the staple magazine, it is only necessary to move it to the right in FIG. 1 and this moves the pivot pin 45 in the aperture 44 against the pressure of the spring 46. The finger 41 travels out of the notch 43 and the staple magazine is free to rotate about the pivot pin 45. The new staples can be placed in the machine and the staple magazine rotates upwardly. In its upward movement, the finger 42 slides over an inclined surface along the edge of the rabbets 38 and eventually lodges in the notch 43 once more. The fact that the leaf spring 46 not only extends from side wall to side wall, but also is locked in place by the abutment 47 and the cylindrical surface of the abutments 48 engaging similar semi-circular portions of the spring, means that the spring will not become easily dislodged with use. The side wall and all of the pertinent materials are formed as injection moldings from a high density polymer, which in the preferred embodiment is Lexan. It should be noted that, when the stapler is not in use, the actuating lever 22 can be locked against accidental operation by pressing button 76 of the pivot pin 49 inwardly; at that time the abutment or key engages a keyway or notch not only on the frame itself, but also on the actuating handle.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A stapler, comprising:
(a) a frame having two spaced, parallel side walls, each in the shape of a closed plane figure formed of a high-density polymer having an integral peripheral web, the webs engaging at a central plane midway between the side walls, said frame having a bore with a notch in the surface which defines the bore,
(b) a hammer slidable between the side walls,
(c) a spring residing between the side walls and engaging the hammer at one end, each side wall having an inwardly-directed flange, the side walls and the flanges forming a cavity enclosing the other end of the spring,
(d) an actuating lever provided with a bore and a notch in the wall which defines the lever bore,
(e) a pin extending through the bores in the frame and lever to permit hinged movement of the lever, said pin having a protuberance, said pin being slidable in said bores transversely of the frame from a release position where the protuberance is outside of the notch in the lever bore, to a locking position in which the protuberance engages the notches in the frame bore and the notch in the lever bore, and
(f) a lifter connected to the lever for lifting the hammer against the pressure of the spring and for releasing said hammer to drive a staple when the pin is in the release position.

2. A stapler, comprising:
(a) a frame having two spaced, parallel side walls, each in the shape of a closed plane figure, formed of a high-density polymer and having an integral peripheral web, the webs engaging at a central plane midway between the side walls, said frame being provided with a straight bottom edge, each side wall having a rabbet along the outside of the bottom edge, the rearward end of the frame having an aperture elongated in the forward and rearward directions, and the forward end of the frame having a rearwardly facing notch,
(b) a hammer slidable between the side walls,
(c) a staple magazine mounted along said bottom edge, formed with a channel element of U-shaped cross-section whose legs reside in and are slidable lengthwise of the rabbets, the width of said channel element being no greater than the width of the stapler, the forward end of the channel element having a finger for engaging the notch in the frame, the rearward end of the channel element having a pivot pin which extends into the aperture in the frame to act as a hinge element.
(d) means for biasing the channel element forwardly relative to the frame so that the finger is maintained tightly engaged in the notch in the frame to prevent rotation of the staple magazine about the pivot pin,
(e) a spring residing between the sidewalls and engaging the hammer at one end,
(f) an actuating lever hinged to the frame, and
(g) a lifter connected to the lever for lifting the hammer against the resistance of said spring and for releasing the hammer to drive a staple.

* * * * *